US008844717B1

(12) United States Patent
Ross

(10) Patent No.: US 8,844,717 B1
(45) Date of Patent: Sep. 30, 2014

(54) COLLAPSIBLE UPRIGHT TOOL CADDY SYSTEM

(71) Applicant: Stacy R. Ross, Topeka, KS (US)

(72) Inventor: Stacy R. Ross, Topeka, KS (US)

( * ) Notice: Subject to any disclaimer, the term of this patent is extended or adjusted under 35 U.S.C. 154(b) by 0 days.

(21) Appl. No.: 14/059,706

(22) Filed: Oct. 22, 2013

Related U.S. Application Data

(63) Continuation-in-part of application No. 13/659,120, filed on Oct. 24, 2012, now abandoned.

(51) Int. Cl.
*B65D 85/28* (2006.01)

(52) U.S. Cl.
USPC ..... 206/373; 182/129; 224/576

(58) Field of Classification Search
USPC ..... 206/372, 373, 374, 375; 224/576, 577, 224/607; 383/38; 182/129
See application file for complete search history.

(56) References Cited

U.S. PATENT DOCUMENTS

| | | | |
|---|---|---|---|
| 4,773,535 | A | 9/1988 | Cook |
| D316,485 | S | 4/1991 | Seber |
| 5,050,713 | A | 9/1991 | Lee |
| 5,370,246 | A | 12/1994 | Traynor |
| D380,276 | S | 6/1997 | Gaona et al. |
| 5,638,915 | A | 6/1997 | Hardy |
| 5,639,003 | A | 6/1997 | Utzinger, III |
| 5,890,639 | A | 4/1999 | Hancock et al. |
| 5,961,018 | A | 10/1999 | Abelbeck et al. |
| 5,971,101 | A | 10/1999 | Taggart |
| 6,116,419 | A | 9/2000 | Campagna et al. |
| 6,179,185 | B1 | 1/2001 | Oancyger |
| 6,516,948 | B1 | 2/2003 | Caballero |
| D482,524 | S | 11/2003 | Cabrera et al. |
| 7,011,241 | B2 | 3/2006 | Godshaw et al. |
| 7,757,911 | B2 | 7/2010 | Barker |
| 2002/0027091 | A1 | 3/2002 | Brown |
| 2002/0070137 | A1 | 6/2002 | Hedges |
| 2002/0092785 | A1 | 7/2002 | Lungo |

*Primary Examiner* — Andrew Perreault

(57) ABSTRACT

A collapsible upright tool caddy system for toting and storing tools and job site equipment features a first tool caddy panel with a first panel stiff pocket located on a first panel front surface. A closed loop first handle is located on a first tool caddy panel top edge. The system features a second tool caddy panel with a second panel stiff pocket located on a second panel front surface. A closed loop second handle is located on a second tool caddy panel top edge. The first tool caddy panel top edge is pivotally located on the second tool caddy panel top edge and secured via a joining panel enveloping the first tool caddy panel and the second tool caddy panel at the first tool caddy panel top edge and the second tool caddy panel top edge via a joining panel channel.

10 Claims, 5 Drawing Sheets

COLLAPSIBLE UPRIGHT TOOL CADDY SYSTEM

CROSS REFERENCE

This application claims priority to U.S. patent application Ser. No. 13/659,120 filed Oct. 24, 2012, the specification(s) of which is/are incorporated herein in their entirety by reference.

FIELD OF THE INVENTION

The present invention relates to tool caddies, or more specifically tool caddies for use with ladders and roof tops.

BACKGROUND OF THE INVENTION

Tool boxes and tool caddies have been used, nearly as long as a need for multiple tools to be carried or stored has existed. Laborers and handymen alike appreciate an effective and efficient transport and storage system. The present invention features a collapsible upright tool caddy system for toting and storing tools and job site equipment in a generally upright manner that is convenient for a user.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a collapsible upright tool caddy system for toting and storing tools and job site equipment in a generally upright manner that is convenient for a user. In some embodiments, the system comprises a first tool caddy panel having a first panel front surface and a first panel back surface.

In some embodiments, the first tool caddy panel comprises a first panel stiff pocket. In some embodiments, the first panel stiff pocket is located on the first panel front surface. In some embodiments, the first panel stiff pocket comprises a planar bottom surface. In some embodiments, a closed loop first handle is located on a first tool caddy panel top edge.

In some embodiments, the system comprises a second tool caddy panel. In some embodiments, the second tool caddy panel comprises a second panel stiff pocket. In some embodiments, the second panel stiff pocket is located on the second panel front surface. In some embodiments, a closed loop second handle is located on a second tool caddy panel top edge.

In some embodiments, the system comprises a stiff rectangular joining panel comprising a joining panel channel located between a joining panel first side and a joining panel second side. In some embodiments, the joining panel comprises a cylindrical first holding loop located at a joining panel first edge and a cylindrical second holding loop located at a joining panel second edge.

In some embodiments, the first tool caddy panel top edge is pivotally located on the second tool caddy panel top edge and secured via the joining panel enveloping the first tool caddy panel and the second tool caddy panel at the first tool caddy panel top edge and the second tool caddy panel top edge via the joining panel channel.

DESCRIPTION OF PREFERRED EMBODIMENTS

Figure 1:
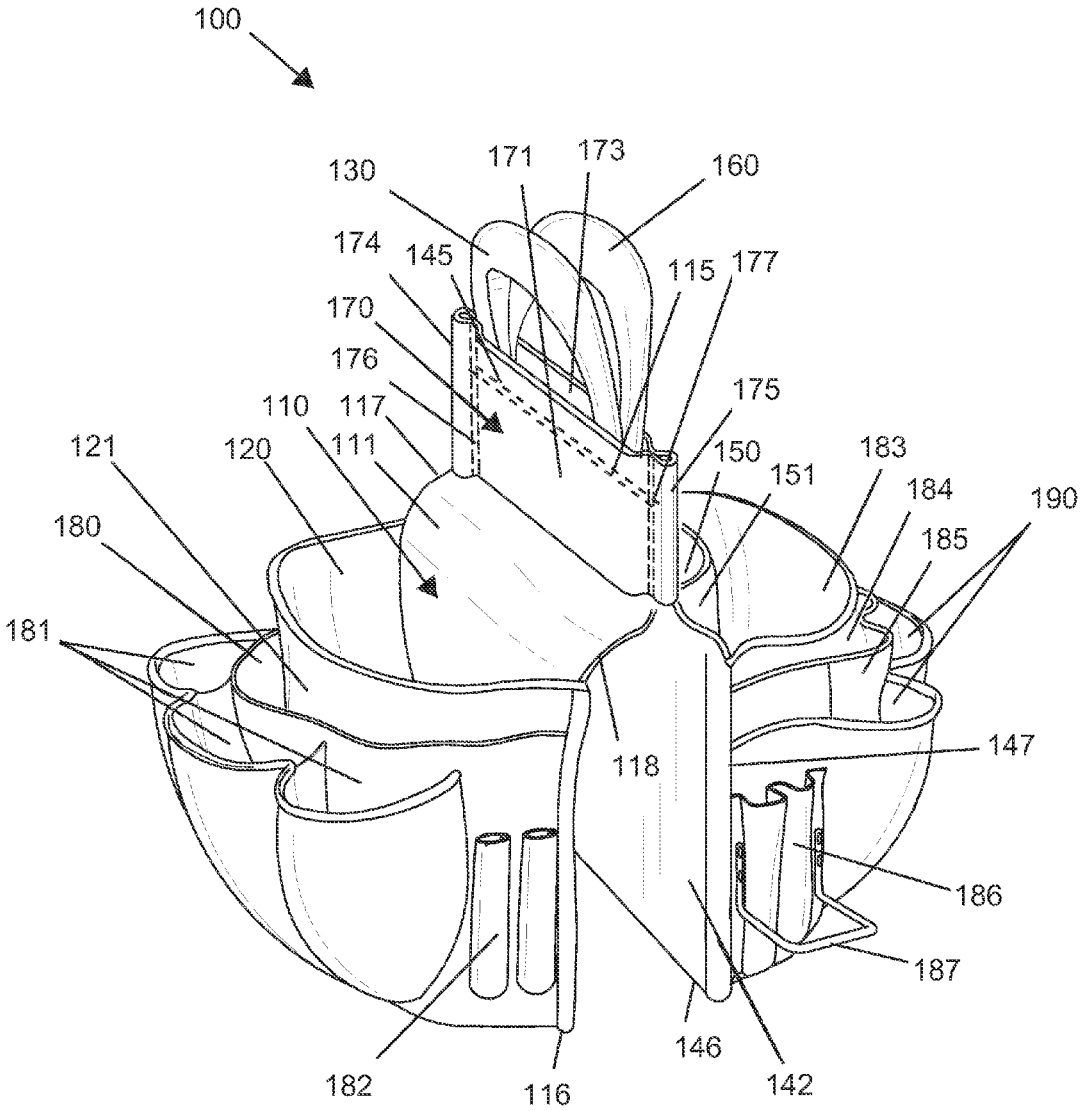
FIG. 1 shows a perspective view of the present invention.
Figure 2:
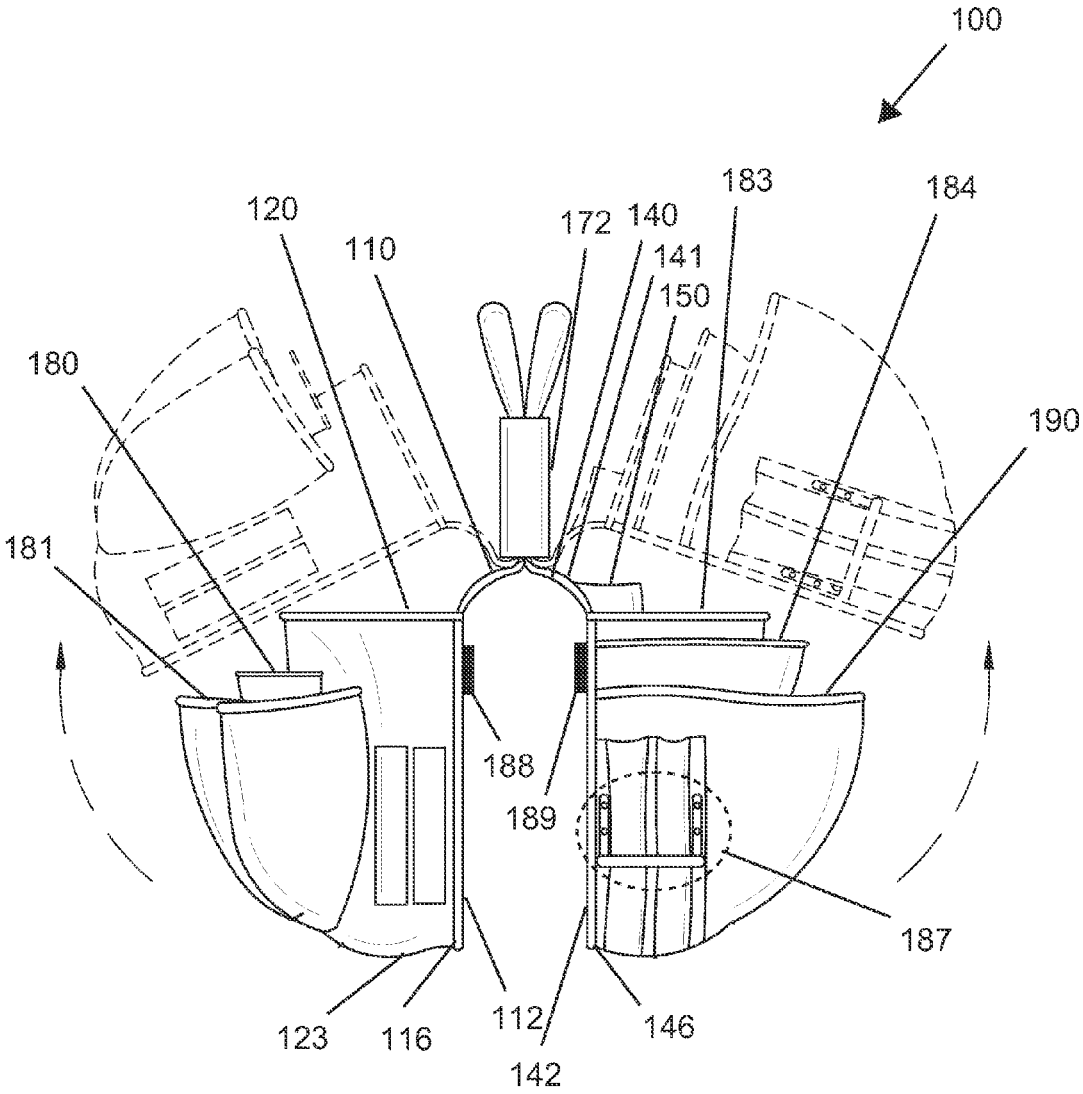
FIG. 2 shows a side view of the present invention.
Figure 3:
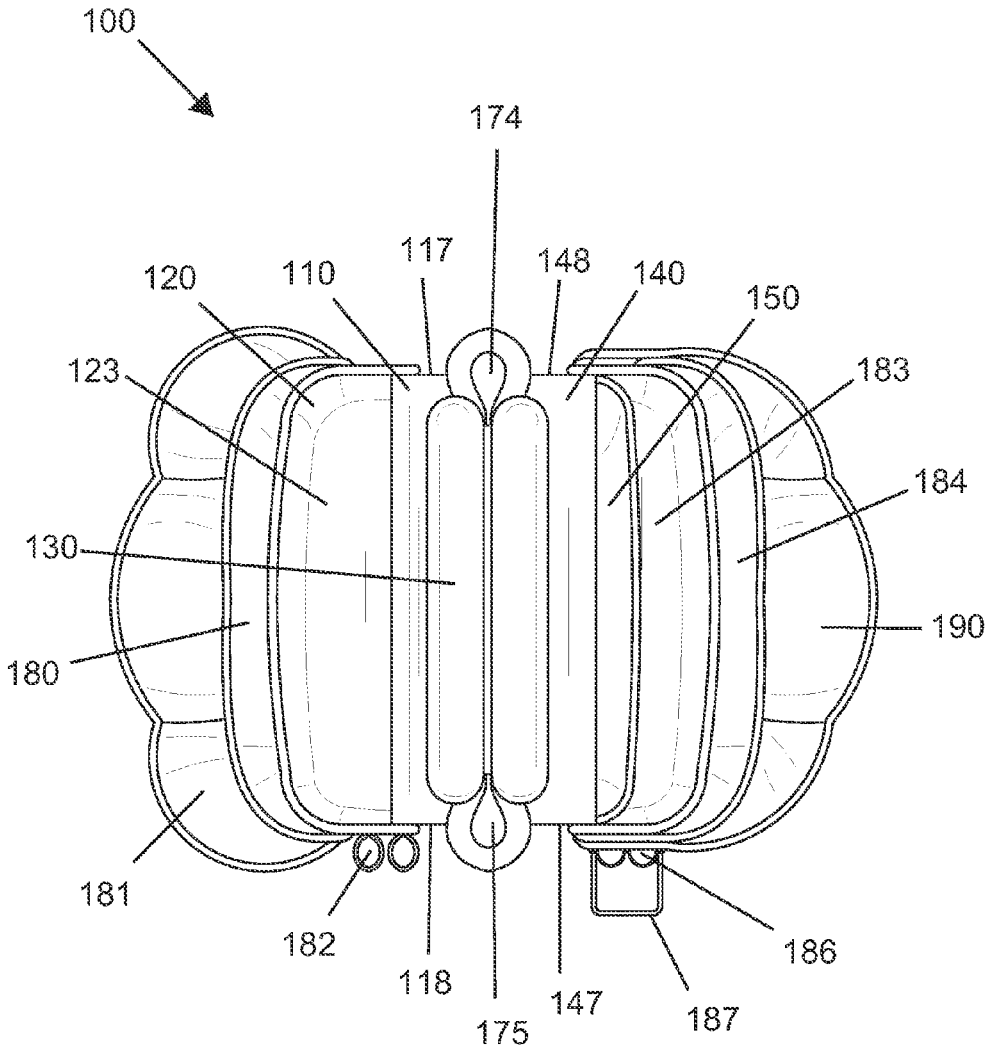
FIG. 3 shows a top view of the present invention.
Figure 4:
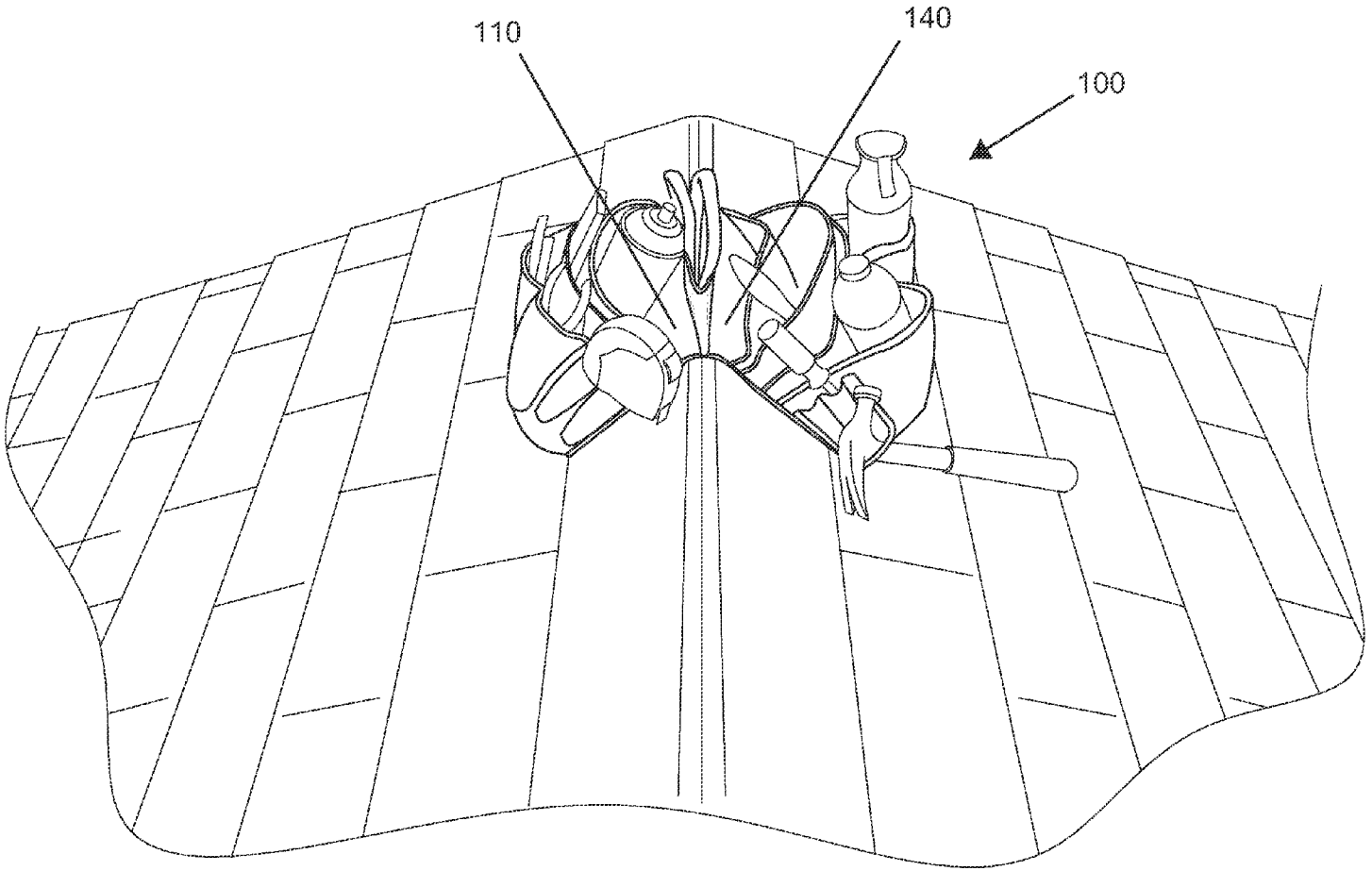
FIG. 4 shows a perspective view of the present invention.
Figure 5:
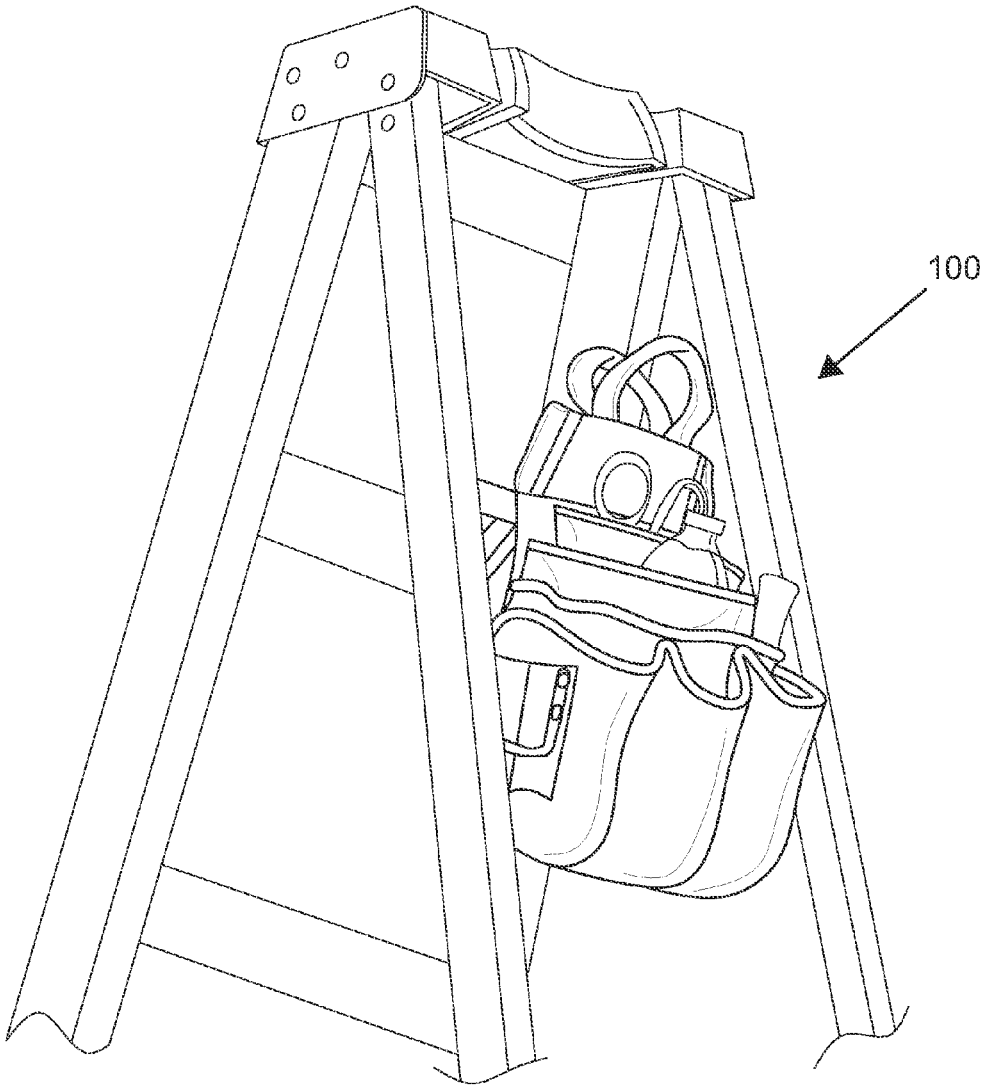
FIG. 5 shows a perspective view of the present invention.

Following is a list of elements corresponding to a particular element referred to herein:

100 Tool caddy system
110 First tool caddy panel
111 First panel front surface
112 First panel back surface
115 First panel top edge
116 First panel bottom edge
117 First panel first edge
118 First panel second edge
120 First panel stiff pocket
121 First panel stiff pocket front surface
123 First panel stiff pocket bottom surface
130 First handle
140 Second tool caddy panel
141 Second panel front surface
142 Second panel back surface
145 Second panel top edge
146 Second panel bottom edge
147 Second panel first edge
148 Second panel second edge
150 Second panel stiff pocket
151 Second panel stiff pocket front surface
160 Second handle
170 Joining panel
171 Joining panel first side
172 Joining panel second side
173 Joining panel channel
174 First holding loop
175 Second holding loop
176 Joining panel first edge
177 Joining panel second edge
180 First panel first pocket
181 First panel second pocket
182 Pencil or bit holder
183 Second panel first pocket
184 Second panel second pocket
185 Second panel second pocket front surface
186 Tool handle holder
187 Tool holding ring
188 First attaching means
189 Second attaching means
190 Second panel third pocket Referring now to FIG. 1-5, the present invention features a collapsible upright tool caddy system (100) for toting and storing tools and job site equipment in a generally upright manner that is convenient for a user. In some embodiments, the system (100) comprises a first tool caddy panel (110) having a first panel front surface (111) and a first panel back surface (112). In some embodiments, the first tool caddy panel (110) comprises a first panel stiff pocket (120) having a first panel stiff pocket front surface (121). In some embodiments, the first panel stiff pocket (120) is located on the first panel front surface (111) flush with a first panel bottom edge (116), a first panel first edge (117), and a first panel second edge (118). In some embodiments, the first panel stiff pocket (120) comprises a planar first panel stiff pocket bottom surface (123). In some embodiments, a closed loop first handle (130) is located on a first panel top edge (115).

In some embodiments, the system (100) comprises a second tool caddy panel (140) having a second panel front surface (141) and a second panel back surface (142). In some embodiments, the second tool caddy panel (140) comprises a second panel stiff pocket (150) having a second panel stiff pocket front surface (151). In some embodiments, the second panel stiff pocket (150) is located on the second panel front surface (141) flush with a second panel bottom edge (146), a second panel first edge (147), and a second panel second edge (148). In some embodiments, a closed loop second handle (160) is located on a second panel top edge (145).

In some embodiments, the system (100) comprises a stiff rectangular joining panel (170) having a joining panel first side (171) and a joining panel second side (172). In some embodiments, the joining panel (170) comprises a joining panel channel (173) located between the joining panel first side (171) and the joining panel second side (172).

In some embodiments, the joining panel (170) comprises a cylindrical first holding loop (174) located at a joining panel first edge (176) and a cylindrical second holding loop (175) located at a joining panel second edge (177). In some embodiments, the first holding loop (174) and the cylindrical second holding loop (175) are designed to hold pencils and driver bits in a vertical upright position close to where a hand of a user is placed for carrying the system (100) via the first handle (130) and the second handle (160) for easy reach.

In some embodiments, the first panel top edge (115) is pivotally attached at the second panel top edge (145) and secured via the joining panel (170) enveloping the first tool caddy panel (110) and the second tool caddy panel (140) at the first panel top edge (115) and the second panel top edge (145) via the joining panel channel (173). In some embodiments, the first panel back surface (112) faces the second panel back surface (142).

In some embodiments, for use, tools and job site equipment are located in any combination of the first panel stiff pocket (120) and or the second panel stiff pocket (150). In some embodiments, the tool caddy system (100) is carried via the first handle (130) and the second handle (160) which are adjacent to one another.

In some embodiments, the tool caddy system (100) is designed to be placed over and suspended from a rung of a ladder via placing the system (100) over the rung between the first panel back surface (112) and the second panel back surface (142) at an intersecting interface created by the enveloping of the joining panel (170) over the first tool caddy panel (110) and the second tool caddy panel (140). In some embodiments, a first attaching means (188) attachably connects to a second attaching means (189) to secure the system (100) to the rung. In some embodiments, the joining panel (170) remains upright as the first tool caddy panel (110) and the second tool caddy panel (140) dangle from the rung.

In some embodiments, the tool caddy system (100) is designed to be rested on a roof peak by placing the system (100) over the peak at the intersecting interface created by the enveloping of the joining panel (170) over the first tool caddy panel (110) and the second tool caddy panel (140). In some embodiments, the first panel back surface (112) and the second panel back surface (142) rest flatly against sides of a roof top.

In some embodiments, the tool caddy system (100) is designed to collapsibly spread for storage of the system (100) and contents and retain the entire contents of the first panel stiff pocket (120) and the second panel stiff pocket (150) without falling out via lying the first panel back surface (112) and the second panel back surface (142) flatly against a level surface on a plane. In some embodiments, the openings of both the first panel stiff pocket (120) and the second panel stiff pocket (150) face each other with the joining panel (170) vertically located in between. In some embodiments, the joining panel (170) remains vertically erect to cover and block tools and job side equipment stored in the first panel stiff pocket (120) and the second panel stiff pocket (150) from exiting.

In some embodiments, a first panel first pocket (180) is located on the first panel stiff pocket front surface (121).

In some embodiments, one or more first panel second pockets (181) is located on a first panel first pocket front surface.

In some embodiments, a tubular pencil or bit holder (182) is located on the first panel first pocket front surface.

In some embodiments, a second panel first pocket (183) is located on the second panel stiff pocket front surface (151).

In some embodiments, one or more second panel second pockets (184) is located on a second panel first pocket front surface. In some embodiments, the second panel stiff pocket (150) comprises a planar bottom surface.

In some embodiments, one or more second panel third pockets (190) is located on a second panel second pocket front surface (185).

In some embodiments, the system (100) comprises a tubular tool handle holder (186) located thereon.

In some embodiments, the system (100) comprises a rigid tool holding ring (187) located thereon.

In some embodiments, a first attaching means (188) is located on the first panel back surface (112). In some embodiments, a mated second attaching means (189) is located on the second panel back surface (142). In some embodiments, the first attaching means (188) and the second attaching means (189) connect to hold the first tool caddy panel (110) to the second tool caddy panel (140).

In some embodiments, a second panel first pocket (183) is located on the second panel stiff pocket front surface (151). In some embodiments, the tool caddy system (100) is designed to collapsibly spread for storage and retain the entire contents of the first panel stiff pocket (120), the second panel stiff pocket (150), and the second panel first pocket (183) via lying the first panel back surface (112) and the second panel back surface (142) flatly against a level surface. In some embodiments, the opening of the first panel stiff pocket (120) faces the opening of the second panel stiff pocket (150) and the second panel first pocket (183). In some embodiments, the joining panel (170) remains vertically erect to cover and block tools and job side equipment stored in the first panel stiff pocket (120), the second panel stiff pocket (150), and the second panel first pocket (183) from exiting.

In some embodiments, the system comprises a roof. In some embodiments, the system comprises a roof peak. In some embodiments, the system comprises a ladder.

As used herein, the term "about" refers to plus or minus 10% of the referenced number.

The disclosures of the following U.S. Patents are incorporated in their entirety by reference herein: U.S. Pat. No. 7,757,911: U.S. Pat. No. 7,011,241: U.S. Pat. No. 6,116,419; U.S. Pat. No. 6,516,948; U.S. Pat. No. 5,971,101; U.S. Pat. No. 5,961,018; U.S. Pat. No. 5,639,003; U.S. Pat. No. 5,638,915; U.S. Pat. No. 5,370,246; U.S. Pat. No. 4,773,535; U.S. Pat. No. D 380,276; U.S. Patent Pub. No. 2002/0027091; U.S. Patent Pub. No. 2002/0070137; and U.S. Patent Pub. No. 2002/0092785.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A collapsible upright tool caddy system (100) for toting and storing tools and job site equipment in a generally upright manner that is convenient for a user, wherein the system (100) comprises:

(a) a first tool caddy panel (110) having a first panel front surface (111) and a first panel back surface (112), wherein the first tool caddy panel (110) comprises a first panel stiff pocket (120) having a first panel stiff pocket front surface (121), wherein the first panel stiff pocket (120) is disposed on the first panel front surface (111) flush with a first panel bottom edge (116), a first panel first edge (117), and a first panel second edge (118), wherein the first panel stiff pocket (120) comprises a planar first panel stiff pocket bottom surface (123), wherein a dosed loop first handle (130) is disposed on a first panel top edge (115);

(b) a second tool caddy panel (140) having a second panel front surface (141) and a second panel back surface (142), wherein the second tool caddy panel (140) comprises a second panel stiff pocket (150) having a second panel stiff pocket front surface (151), wherein the second panel stiff pocket (150) is disposed on the second panel front surface (141) flush with a second panel bottom edge (146), a second panel first edge (147), and a second panel second edge (148), wherein a dosed loop second handle (160) is disposed on a second panel top edge (145); and (c) a stiff rectangular joining panel (170) having a joining panel first side (171) and a joining panel second side (172), wherein the joining panel (170) comprises a joining panel channel (173) disposed between the joining panel first side (171) and the joining panel second side (172), wherein the joining panel (170) comprises a cylindrical first holding loop (174) disposed at a joining panel first edge (176) and a cylindrical second holding loop (175) disposed at a joining panel second edge (177);

wherein the first panel top edge (115) is pivotally disposed on the second panel top edge (145) and secured via the joining panel (170) enveloping the first tool caddy panel (110) and the second tool caddy panel (140) at the first panel top edge (115) and the second panel top edge (145) via the joining panel channel (173);

wherein for use, tools and job site equipment are disposed in the first panel stiff pocket (120) or the second panel stiff pocket (150), wherein the tool caddy system (100) is carried via the first handle (130) and the second handle (160) which are adjacent to one another;

wherein the tool caddy system (100) is designed to be placed over and suspended from a rung of a ladder via placing the system (100) over the rung between the first panel back surface (112) and the second panel back surface (142) at an intersecting interface created by the enveloping of the joining panel (170) over the first tool caddy panel (110) and the second tool caddy panel (140);

wherein the tool caddy system (100) is designed to be rested on a roof peak by placing the system (100) over the peak at the intersecting interface created by the enveloping of the joining panel (170) over the first tool caddy panel (110) and the second tool caddy panel (140), wherein the first panel back surface (112) and the second panel back surface (142) rest flatly against sides of a roof top;

wherein the tool caddy system (100) is designed to collapsibly spread for storage and retain the entire contents of the first panel stiff pocket (120) and the second panel stiff pocket (150) via lying the first panel back surface (112) and the second panel back surface (142) flatly against a level surface, wherein the openings of both the first panel stiff pocket (120) and the second panel stiff pocket (150) face each other, wherein the joining panel (170) remains vertically erect to cover and block tools and job side equipment stored in the first panel stiff pocket (120) and the second panel stiff pocket (150) from exiting.

2. The system (100) of claim 1, wherein a first panel first pocket (180) is disposed on the first panel stiff pocket front surface (121).

3. The system (100) of claim 2, wherein one or more first panel second pockets (181) is disposed on a first panel first pocket front surface.

4. The system (100) of claim 2, wherein a tubular pencil or bit holder (182) is disposed on the first panel first pocket front surface.

5. The system (100) of claim 1, wherein a second panel first pocket (183) is disposed on the second panel stiff pocket front surface (151), wherein the tool caddy system (100) is designed to collapsibly spread for storage and retain the entire contents of the first panel stiff pocket (120), the second panel stiff pocket (150), and the second panel first pocket (183) via lying the first panel back surface (112) and the second panel back surface (142) flatly against a level surface, wherein the opening of the first panel stiff pocket (120) faces the opening of the second panel stiff pocket (150) and the second panel first pocket (183), wherein the joining panel (170) remains vertically erect to cover and block tools and job side equipment stored in the first panel stiff pocket (120), the second panel stiff pocket (150), and the second panel first pocket (183) from exiting.

6. The system (100) of claim 5, wherein one or more second panel second pockets (184) is disposed on a second panel first pocket front surface, wherein the second panel stiff pocket (150) comprises a planar bottom surface.

7. The system (100) of claim 6, wherein one or more second panel third pockets (190) is disposed on a second panel second pocket front surface (185).

8. The system (100) of claim 1, wherein the system (100) comprises a tubular tool handle holder (186) disposed thereon.

9. The system (100) of claim 1, wherein the system (100) comprises a rigid tool holding ring (187) disposed thereon.

10. The system (100) of claim 1, wherein a first attaching means (188) is disposed on the first panel back surface (112), wherein a mated second attaching means (189) is disposed on the second panel back surface (142), wherein the first attaching means (188) and the second attaching means (189) connect to hold the first tool caddy panel (110) to the second tool caddy panel (140).

* * * * *